US007461431B2

(12) United States Patent
Zoroufy

(10) Patent No.: US 7,461,431 B2
(45) Date of Patent: Dec. 9, 2008

(54) STAIR ROD BRACKET

(75) Inventor: Aboolhassan Zoroufy, Madison, WI (US)

(73) Assignee: Stair-Hold Inc., Madison, WI (US)

( * ) Notice: Subject to any disclaimer, the term of this patent is extended or adjusted under 35 U.S.C. 154(b) by 144 days.

(21) Appl. No.: 11/380,995

(22) Filed: May 1, 2006

(65) Prior Publication Data

US 2006/0191100 A1 Aug. 31, 2006

Related U.S. Application Data

(63) Continuation of application No. 10/486,296, filed as application No. PCT/US02/25293 on Aug. 9, 2002, now abandoned.

(60) Provisional application No. 60/311,192, filed on Aug. 9, 2001.

(51) Int. Cl.
*A47G 27/04* (2006.01)

(52) U.S. Cl. ..... 16/12; 16/11; 16/10

(58) Field of Classification Search ..... 16/10, 16/11, 12, 13

See application file for complete search history.

(56) References Cited

U.S. PATENT DOCUMENTS

| | | | | |
|---|---|---|---|---|
| 144,759 | A | 11/1873 | Gould | |
| 304,951 | A | 9/1884 | Nobes | |
| 391,841 | A | 10/1888 | Gildemeyer | |
| D484,708 | S | 10/1892 | Gates | |
| D701,394 | | 6/1902 | Richards | |
| D737,143 | | 8/1903 | Richards | |
| 737,143 | A * | 8/1903 | Richards | 16/15 |
| D805,307 | | 11/1905 | Mallen | |
| 805,307 | A * | 11/1905 | Mallen | 16/15 |
| D869,492 | | 10/1907 | Joyner | |
| D899,377 | | 9/1908 | Billings | |

(Continued)

FOREIGN PATENT DOCUMENTS

| | | |
|---|---|---|
| CH | 299 315 | 6/1954 |

(Continued)

OTHER PUBLICATIONS

"The Traditional Collection" (also "Victoria Series," "Catherine the Great Series," "Elizabeth Series," "Isabella Series") by Decorative Hardware Studio, Chappaqua, NY (Aug. 1996) 1-6.

(Continued)

*Primary Examiner*—Patricia Engle
*Assistant Examiner*—Mark A. Williams
(74) *Attorney, Agent, or Firm*—Michael Best & Friedrich LLP

(57) ABSTRACT

The present invention provides a transversely interconnecting slidable stair rod bracket. The bracket may also be provided for use in a stair rod set, the set also including a stair carpet retaining rod and a finial. The bracket has a top portion and a bottom portion. The top portion having a plurality of projections and complementary shaped channels for receiving projections from the bottom portion; the bottom portion contains a rod-receiving portion, an outside end wall with an aperture therein for accepting either a threaded finial fastener which engages with a "female" finial, or the fastening portion of a "male" finial, and a plurality of projections and complementary shaped channels for receiving projections from the top portion.

18 Claims, 6 Drawing Sheets

U.S. PATENT DOCUMENTS

| | | | | | |
|---|---|---|---|---|---|
| 899,377 | A | * | 9/1908 | Billings | 16/15 |
| 1,373,148 | A | | 3/1921 | St. John Phillips | |
| 1,624,392 | A | | 4/1927 | Cleverly | |
| 3,487,496 | A | | 1/1970 | Guyton et al. | |
| 3,543,329 | A | | 12/1970 | Gonas et al. | |
| 4,014,122 | A | | 3/1977 | Woods | |
| 5,008,551 | A | | 4/1991 | Randolph | |
| D340,404 | S | | 10/1993 | Prezner | |
| D342,437 | S | * | 12/1993 | Prezner | D8/380 |
| 5,499,427 | A | | 3/1996 | Bowman | |
| 5,519,972 | A | | 5/1996 | Howie, Jr. | |
| 5,598,652 | A | | 2/1997 | Nurre | |
| 5,657,886 | A | | 8/1997 | Tacchella | |
| 5,690,239 | A | | 11/1997 | Ballard | |
| 5,960,516 | A | * | 10/1999 | Zoroufy et al. | 16/12 |
| 6,082,877 | A | | 7/2000 | Hughes | |
| 6,338,179 | B1 | * | 1/2002 | Blackstone | 16/12 |
| 6,435,700 | B1 | | 8/2002 | Graham | |
| 6,701,747 | B2 | | 3/2004 | Hartgrove | |
| D493,359 | S | | 7/2004 | Graves et al. | |
| 6,839,936 | B2 | | 1/2005 | Kaufman | |
| 2003/0097729 | A1 | | 5/2003 | Kaufman | |
| 2004/0020102 | A1 | | 2/2004 | Cramsey | |
| 2006/0130983 | A1 | | 6/2006 | Nien | |

FOREIGN PATENT DOCUMENTS

| | | |
|---|---|---|
| DE | 10239983 | 3/2004 |
| GB | 025921 | 10/1906 |
| GB | 171229 | 11/1921 |
| GB | 414793 | 8/1934 |

OTHER PUBLICATIONS

"Zoroufy Stair Rods, Wall Hangers, Runners," by Zoroufy, Madison, WI covers and pp. 2-11 (1996).
"Zoroufy Stair Rods, Stair-Holds, Wall Hangers," by Zoroufy, Madison, WI, covers and pp. 2-11 (1997).
"Beautiful Brass Stair Rods," by Unique Designs Mfg., Syracuse, NY, 2 pages.
"European Elegance," by Buesche, Inc., Irvine, CA, 2 pages.
"Precious Metals Collection" by Zoroufy, Madison, WI 2 pages.
Renovators, Conway, NH, No. 116 Summer 1997, cover and p. 43.
"Select Stair Rod Sets," by Zoroufy, Madison, WI 1 page.
"Zoroufy Stair Rods Solid Brass Collection," by Zoroufy, Madison, WI, 1 page.

* cited by examiner

STAIR ROD BRACKET

CROSS-REFERENCE TO RELATED APPLICATIONS

This application claims the benefit of priority from U.S. application Ser. No. 10/486,296 filed Feb. 9, 2004, which is a national stage filing under 35 U.S.C. 371 of International Application No. PCT/US02/25293 filed Aug. 9, 2002, which claims priority from U.S. Provisional Application. No. 60/311,192 filed Aug. 9, 2001, incorporated herein by reference.

STATEMENT REGARDING FEDERALLY SPONSORED RESEARCH OR DEVELOPMENT

Not applicable.

This invention relates generally to stair rod brackets and to stair rod sets. In particular the invention relates to slidably interconnecting stair rod brackets and stair rod sets having a pair of slidably interconnecting stair rod brackets, a stair carpet retaining rod and a pair of finials. The invention also includes stair rod bracket kits and stair rod kits using the interconnecting stair rod bracket. The stair rod set is especially useful for releasable fastening carpet runners to a staircase.

Carpet runners or other floor coverings are releasably affixed to stairs using stair rod sets. Many stair rod sets sold today are used as a decorative accent to the stairs and carpet runners. The stair rod set serves a decorative function as well as a useful function in preventing slippage of the carpet runner on the stairs of a staircase. A staircase typically has a plurality of steps. Each step has a riser and a tread. The stair rod set typically includes a pair of brackets with each bracket fastened to the step of a staircase. The brackets are spaced from the edges of the carpet runner and fastened at opposite sides of the step. Stair brackets frequently have a top portion and a bottom portion. Often, the bottom portion is fastened to the riser and the tread of the step of the staircase. A rod extends over the carpet runner and is held between and by the pair of brackets. A pair of finials may be used in conjunction with the stair rod and pair of brackets with one finial attached to each bracket. In some devices, the stair rod extends through the bracket (see U.S. Pat. No. 484,708 to Gates; U.S. Pat. No. 1,373,148 to St. John Phillips; U.S. Pat. No. Des. 343,437 to Prezner); in these instances, the bracket is often referred to as a "stair eye" or "open eye-type bracket" because the bracket has a hole or eye therethrough for accepting the stair rod. The use of a "stair eye" type bracket poses special problems. Should a person, pet or object accidentally get entangled in the rod, the stair rod may slip laterally (transversely/longitudinally) and slide out through the eye of the bracket. This poses a particular danger in certain types of staircases, which are designed as open staircases on one, or both sides. Open staircases are frequently used for their ornamental beauty in clubs, restaurants, hotels, as well as in private homes and apartments. Slippage of the rod could result in the rod falling on persons, pets or objects under and adjacent the open side(s) of the staircase.

Prior art attempts have responded to some of the problems of lateral slippage of the stair rod through the eye of the bracket by the use of a finial at the end of the stair rod. For example, the largest outer diameter of the finial is dimensioned to exceed the diameter of the opening of the bracket eye. Often the finial is not fastened to the rod but is designed with a finial cap to engage about an end of the rod.

Other attempts to solve the problem of the slippage of the stair rod in a stair eye bracket type, have utilized a lug to engage the end of the rod (See e.g., GB patent 414,793).

Yet other attempts to address the problem of slippage have resulted in stair rod brackets having a end wall. The end wall design prevents penetration therethrough by the stair rod. Often for decorative purposes, a female finial is fastened to the end wall of the bracket using a threaded fastener. The term female finial means herein throughout, a finial having an aperture therein for accepting a fastener. An example of a female finial is shown in U.S. Pat. No. Des. 340,404 to Prezner, wherein a screw is threaded through the end wall and into the finial prior to the insertion of the stair rod into the bracket. Use of the stair bracket having an end wall, however, introduces problems associated with ease in opening and closing the brackets for removal of the stair rod in order to remove the carpet for cleaning, and for cleaning and polishing the stair rod, brackets and finials.

Special problems related to easily removing the stair rod from the bracket are associated with both the end wall type bracket and with the open eye-type bracket. Attempts have also been made to resolve these problems with the design of brackets having top portions which are pivotally slidable (e.g., "THE TRADITION COLLECTION" by Decorative Hardware Studio, Chappaqua, N.Y.) or hingeably upliftable (U.S. Pat. No. Des. 342,437; also, see the "VICTORIA SERIES", "CATHERINE THE GREAT SERIES", "ELIZABETH SERIES", and "ISABELLA SERIES" by Decorative Hardware Studio, Chappaqua, N.Y.), or moveably upliftable (U.S. Pat. No. 1,373,148 to St. John Phillips) or traversely slidable or engageable (U.S. Pat. No. 484,708 to Gates, GB Patent 414,793 and U.S. Pat. No. 5,960,516 issued to Zoroufy et al.). The use of brackets having hingeably upliftable, pivotally slidable or moveably upliftable top portions have required the use of fasteners or projections which make the bracket harder to use and more expensive to fabricate. Also the upliftable, pivoting or moveable portions may be subject to breaking off or loosening after extended use. In addition, cleaning and polishing these types of brackets is more difficult because they have more parts and recesses that require cleaning. Further, the messy job of cleaning and polishing the top portion of the bracket frequently must be done on the staircase, unless both the top portion and the bottom portion of the bracket are removed.

Another problem with stair eye brackets which are traversely engageable is that accidentally jarring the top portion of the bracket can cause transverse overtravel, e.g., the top portion of the bracket disengages from the bottom portion of the bracket, thus bending the bracket portions and/or the stair rod, or causing the stair rod to fall out of the bracket. Attempts to solve this problem using springs and plungers are known (See, e.g., GB Patent 414,793). However, the use of springs and plungers adds to the complexity of using the bracket and the costs of making the bracket. Attempts at solving this problem have also been done by providing a traversal stop for one of the portions of the bracket with respect to the other. This, however, provides that the two portions of the bracket can only be connected by the sliding of one piece into the other in one direction. This can be a problem when the brackets are connected in a tight corner, where limiting the connection of the two portions of the bracket in only one direction can make installation difficult. Yet another problem with traversely engageable stair rod brackets, is that they often are connected together with dove-tail connections. In such a bracket design, one of the bracket members contains sharp edge connecting projections. Such sharp edge connections are easily dented. This leads to difficulty in slidably connecting the two members together to form the stair rod bracket, as the dove-tail projection cannot fit together correctly.

Still a further problem occurs when a person accidentally steps on the rod. The application of pressure to the rod frequently causing bowing of the rod. In some instances, the bowing of the rod causes the rod to come out of the brackets. This, of course, may pose a safety problem, since, in addition, to the possibility of the lateral slippage, there is the possibility that the person may slip on the rod while walking up the steps.

Yet another problem exists when it is desired to change the decorative look of the stair rod set. This can be expensive and time consuming. This change frequently requires the purchase of new pairs of brackets, which require installation and possible refinishing of the holes in the steps made by the fasteners which held the old brackets in place on the staircase.

A further problem with two-piece stair rod brackets, is that the interlocking design of the brackets can only be accomplished by casting the metal for each piece in separate molds. This can often lead to problems with the two pieces fitting together snugly to provide a tight fitting stair rod bracket, as variations in the separate molds often arise.

SUMMARY OF THE INVENTION

The present invention provides a stair rod bracket and a stair rod set. The stair rod bracket is slidably interconnected for easy assembly and disassembly. The stair rod set includes a pair of slidable interconnecting stair rod brackets, a stair carpet retaining rod and a pair of finials. The stair rod set is advantageously useful for releasably fastening a carpet runner to a staircase. The invention also provides a stair rod bracket kit and a stair rod set kit having the slidable interconnecting stair rod brackets.

The foregoing, and other advantages of the present invention, are realized in one aspect thereof, in a transversely interconnecting slidable stair rod bracket for use in a stair rod set, the set also includes a stair carpet retaining rod and a finial. The bracket has a top portion and a bottom portion. The top portion having a plurality of projections and complementary shaped channels for receiving projections from the bottom portion; the bottom portion contains a rod-receiving portion, an outside end wall with an aperture therein for accepting either a threaded finial fastener which engages with a "female" finial, or the fastening portion of a "male" finial, and a plurality of projections and complementary shaped channels for receiving projections from the top portion.

Specifically, the plurality of projections of the top portion have corresponding complementary channels disposed on the bottom portion, and the plurality of projections of the bottom portion have corresponding complementary channels disposed in the top portion. The plurality of projections are suitably rounded projections and the plurality of channels are correspondingly rounded shaped channels. The outside end wall is a plate extending from the bottom portion, and is spaced apart from the rod-receiving portion of the bottom portion of the bracket. The outside end wall is dimensioned to pass through the rod-receiving portion of the top portion of the bracket when the top portion of the bracket is transversely engaged with the bottom portion of the bracket.

In another aspect, the present invention includes a stair rod set including a stair carpet retaining rod, a pair of finials; and a pair of stair rod brackets. Each bracket has a top portion and a bottom portion. The top portion suitably has a plurality of projections and complementary shaped channels for receiving projections disposed on the bottom portion; the bottom portion suitably contains a rod-receiving portion, an outside end wall with an aperture therein for accepting either a threaded finial fastener which engages with a "female" finial, or the fastening portion of a "male" finial, and a plurality of projections and complementary shaped channels for receiving projections disposed on the top portion. The plurality of projections of the top portion have corresponding complementary channels disposed on the bottom portion, and the plurality of projections of the bottom portion have corresponding complementary channels disposed in the top portion. The plurality of projections are suitably rounded projections and the plurality of channels are correspondingly rounded shaped channels. The outside end wall is a plate extending from the bottom portion, and is spaced apart from the rod-receiving portion of the bottom portion of the bracket. The outside end wall is dimensioned to pass through the rod-receiving portion of the top portion of the bracket when the top portion of the bracket is transversely engaged with the bottom portion of the bracket.

A further aspect of the present invention includes a stair rod bracket kit for use in a stair rod set, the set having a stair bracket, a stair carpet retaining rod and a finial either having a male fastening projection, or a female fastener receiving aperture. The stair rod bracket kit includes a) a plurality of bottom portions of a stair bracket, each of the bottom portions having a face and two end walls extending from the face, one of the end walls having an aperture for the connection of the finial, the other end wall having a rod-receiving portion for accepting a portion of the rod; b) a plurality of top portions of a bracket for use with any one of the plurality of bottom portions, the top portions having a face and end walls, the end walls being dimensioned to provide a rod-receiving portion, for accepting a portion of the rod; and c) a plurality of projections and complementary shaped channels for receiving the projections disposed on the top portion and the bottom portion for transverse engagement of the top portion with the bottom portion; the plurality of projections disposed on the top portion having corresponding complementary channels disposed on the bottom portion, and the plurality of projections in the bottom portion having corresponding complementary channels disposed in the top portion. The plurality of projections are suitably rounded projections and the plurality of channels are correspondingly rounded shaped channels.

In yet another aspect, the present invention includes a stair rod set kit which comprises (a) a stair carpet retaining rod; (b) a pair of finials, and (c) a pair of stair brackets, each bracket of the pair of brackets having i) a plurality of bottom portions of a bracket, each of the bottom portions having a face and two end walls extending from the face, one of the end walls having an aperture therein for accepting the male fastening portion of the finial, the other end wall having a rod-receiving portion for accepting a portion of the rod; ii) a plurality of top portions of a bracket for use with any one of the plurality of bottom portions, the top portions having a face and end walls, the end walls being dimensioned to provide a rod-receiving portion, for accepting a portion of the rod; and iii) a plurality of projections and complementary shaped channels for receiving the projections disposed on the top portion and the bottom portion for transverse engagement of the top portion with the bottom portion; the plurality of projections disposed on the top portion having corresponding complementary channels disposed on the bottom portion, and the plurality of projections in the bottom portion have corresponding complementary channels disposed in the top portion. The plurality of projections are suitably rounded projections and the plurality of channels are correspondingly rounded shaped channels.

It is understood that one skilled in the are would appreciate various modifications, including variations, additions, and omissions of the present invention. Other advantages and a fuller appreciation of the specific attributes of this invention will be gained upon an examination of the following drawings, detailed description of preferred embodiments, and appended claims. It is expressly understood that the drawings are for the purpose of illustration and description only, and are not intended as a definition of the limits of the invention.

BRIEF DESCRIPTION OF THE DRAWING(S)

The preferred exemplary embodiment of the present invention will hereinafter be described in conjunction with the appended drawing wherein like designations refer to like elements throughout and in which.

DETAILED DESCRIPTION OF THE INVENTION

Figure 1:
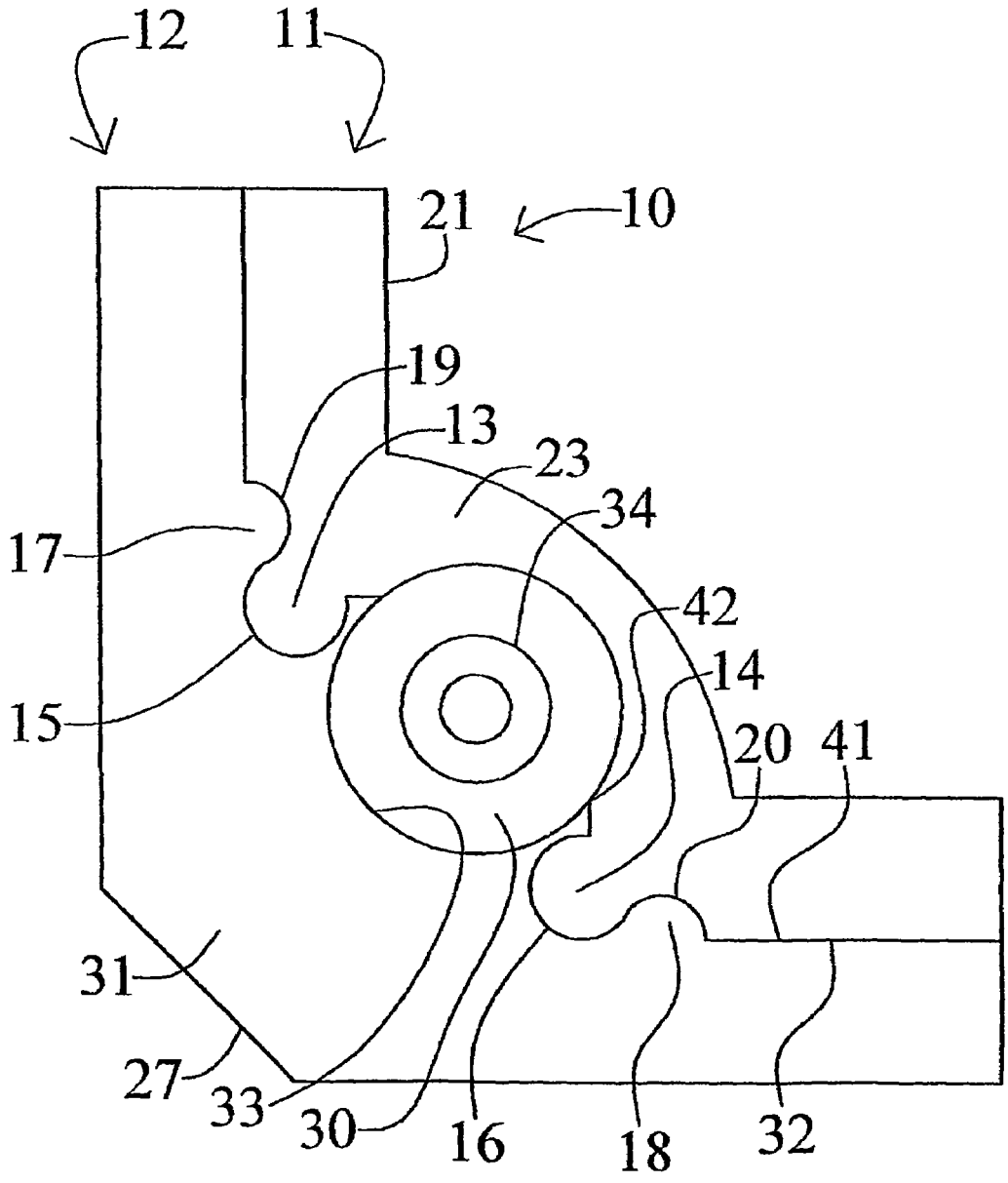
FIG. 1 is a side view of the inside of a right sided stair rod bracket of the present invention.
Figure 2:
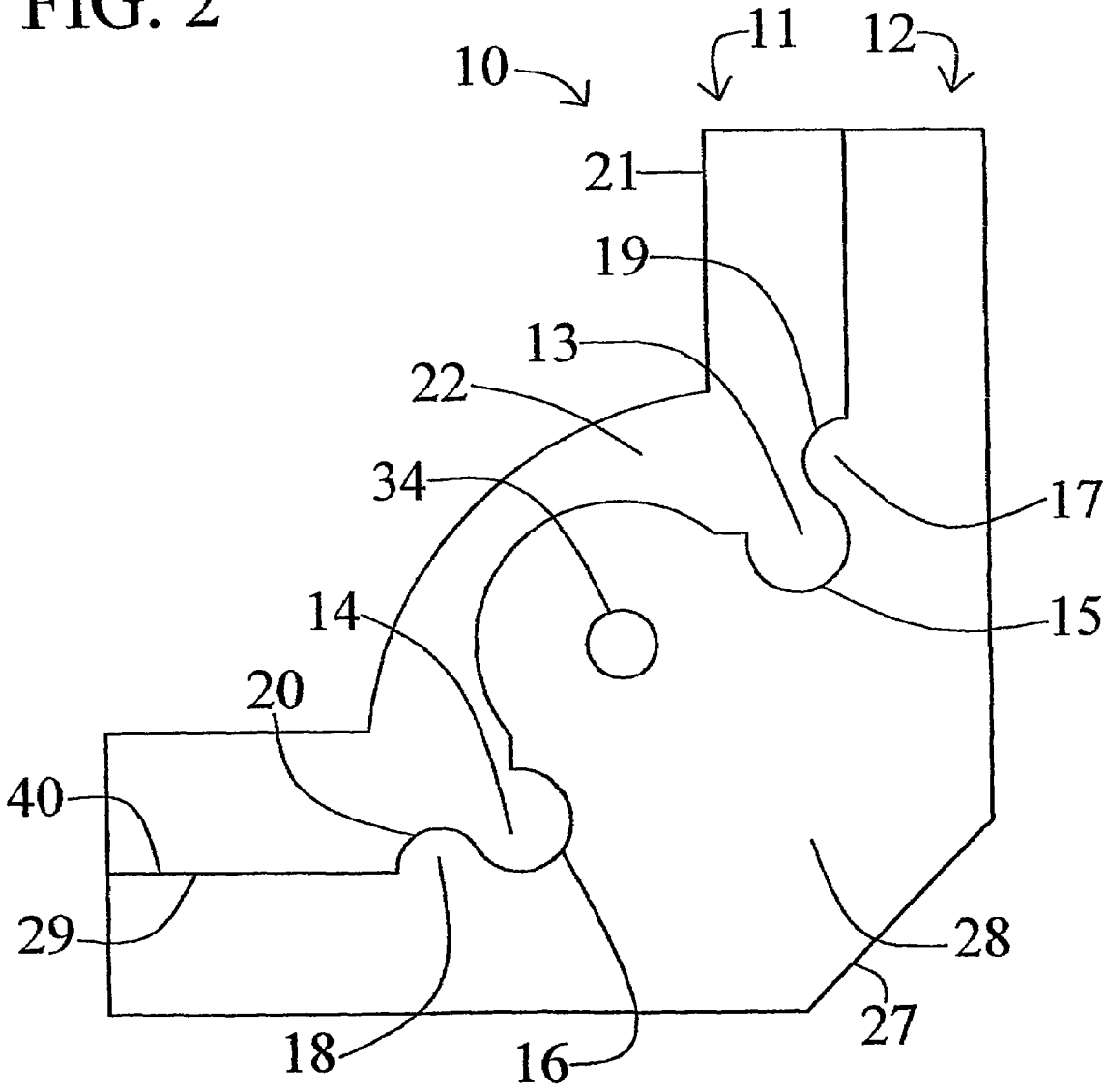
FIG. 2 is a side view of the outside of a right sided stair rod bracket of the present invention.
Figure 3:
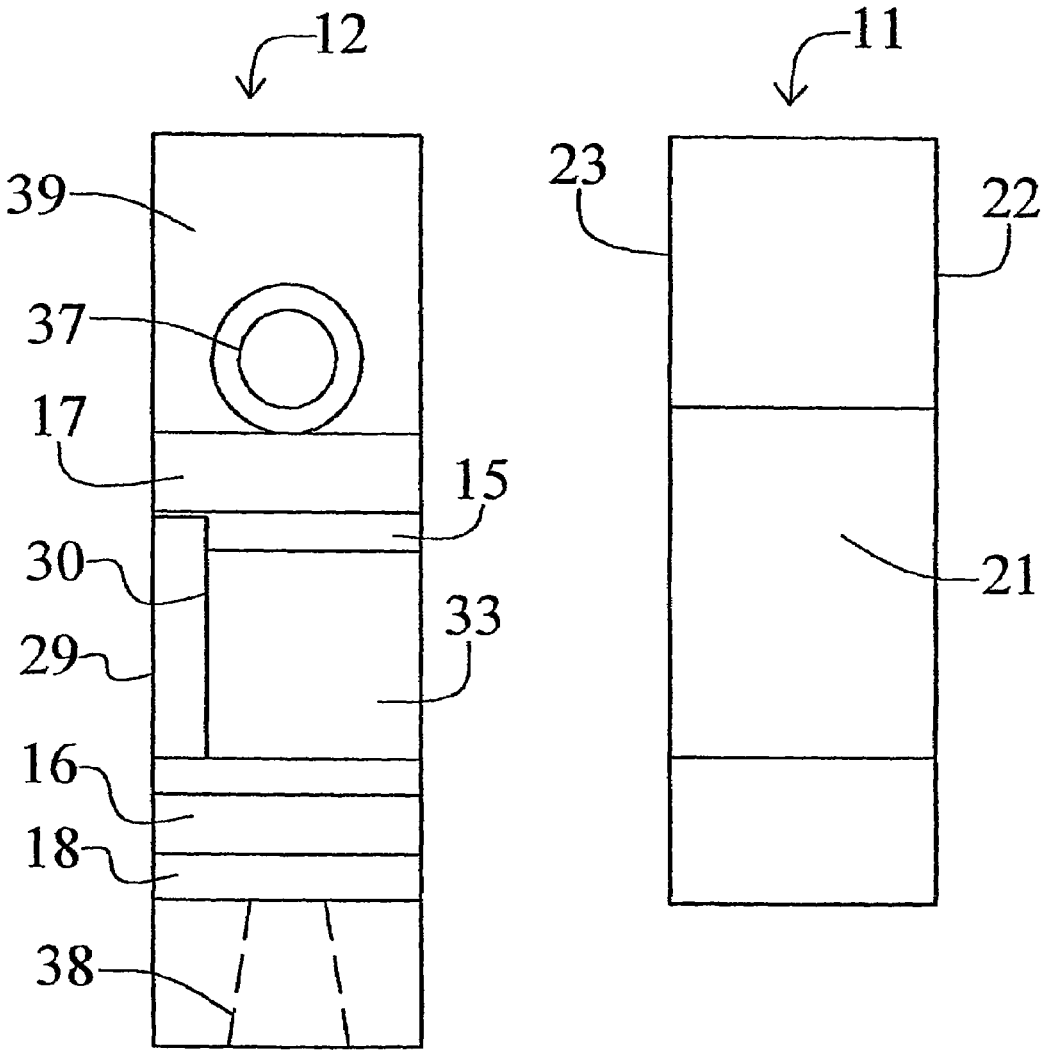
FIG. 3 is a font facing view of the top and bottom portions of a left sided stair rod bracket of the present invention.

The present invention relates broadly to a stair rod bracket. Specifically, the invention provides a stair rod bracket and a stair rod set having a pair of slidably interconnecting stair rod brackets, a stair carpet retaining rod and a pair of finials. Accordingly, the present invention will now be described in detail with respect to such endeavors; however, those skilled in the art will appreciate that such a description of the invention is meant to be exemplary only and should not be viewed as limitative on the full scope thereof.

The stair rod brackets of the present invention are best shown in FIGS. 1-4. A bracket generally designated as reference numeral 10 of the present invention includes a top portion 11 and a bottom portion 12. The top portion 11 and the bottom portion 12 of each bracket 10 slidably engage each other, i.e. they interconnect permitting transverse (lateral) engagement of the top portion 11 with the bottom portion 12. Each bracket 10 has a plurality of projections which engage in a mating fashion in corresponding complementary shaped channels. In the illustrated embodiment shown in FIGS. 1-2, each bracket 10 suitably has projections 13, 14 on the top portion 11 which engage in a mating fashion in correspondingly shaped complementary channels 15, 16, respectively, in the bottom portion 12 of the bracket, and has projections 17, 18 in the bottom portion of the bracket 12 which engage in a mating fashion in correspondingly shaped channels 19, 20, respectively, in the top portion 11 of the bracket. The top portion 11 is slid in a transverse (longitudinal/lateral) manner into the bottom portion 12 of the bracket 10.

In the illustrated embodiment, the projections 13, 14, 17, and 18 and channels 15, 16, 19 and 20 are in the nature of interlocking rounded joints. Alternatively, the bottom portion 12 suitably has a first single projection (17 or 18) and a first single channel (15 or 16), and the top portion 11 suitably has a single corresponding complementary shaped channel (19 or 20) to engagingly mate with the first single projection (17 or 18) and has a corresponding single complementary shaped projection (13 or 14) to engagingly mate with the first single channel (15 or 16) of the bottom portion. Although four projections 13, 14, 17, and 18 with their corresponding channels 15, 16, 19 and 20 are shown, more projections and associated corresponding complementary shaped channels may be used. Other types of combinations of other shaped projections and corresponding complementary shaped channels can be envisioned by those of ordinary skill in the art and are encompassed by the present invention.

As is best shown in FIGS. 1-4, the top portion 11 of the bracket 10 includes a front face 21, a back face 24, two end walls, 22 and 23, respectively, which extend downwardly from the front face 21 to back face 24, and two end wall edges 40 and 41, respectively. The front face 21 of the top portion 11 also includes a first fastener aperture 48, that, when the top portion 11 and bottom portion 12 of the bracket 10 are aligned, brings fastener aperture 48 into alignment with a second fastener aperture 49 in the bottom portion 12. The first and second fastener apertures, 48, 49, are dimensioned to receive a bracket fastener screw 50 which secures the top portion 11 and the bottom portions 12 of the bracket 10 together. The back face 24 of the top portion 11 has a stair rod receiving portion 26.

The bottom portion 12 of the stair bracket 10 includes a front face 39, a back face 27 and two end walls 28 and 31, respectively. End wall 28 is an outside end wall extending upwardly from the back face 27. End wall 31 is an inside end wall extending upwardly from the back face 27. Outside end wall 28 has an outside end wall edge 29, and an inside surface 30. Inside end wall 31 has an inside end wall edge 32, and a stair rod-receiving portion 33. The stair rod-receiving portion 33 is adjacent to the inside surface 30 of the outside end wall 28 and extends from inside surface 30 to the inside end wall 31. The inside end wall 31 is spaced apart from and generally parallel to the outside end wall 28. Outside end wall 28 has an aperture 34 therethrough, suitably dimensioned to permit passage of either a threaded finial fastener 70 which engages with a "female" finial 72, or the fastening portion 74 of a "male" finial 76. The front face 39 of the bottom portion 12 of the stair rod bracket 10 also includes a pair of mounting apertures 37, 38, respectively, therethrough for accepting fasteners (screws, nails, bolts, or the like) to fasten the bottom portion 12 of the bracket 10 to a stair tread and a stair riser of a step of a staircase. When the bracket 10 is assembled, the back face 27 of the bottom portion 12 is disposed facing the stair tread and stair riser of a step.

Figure 4:
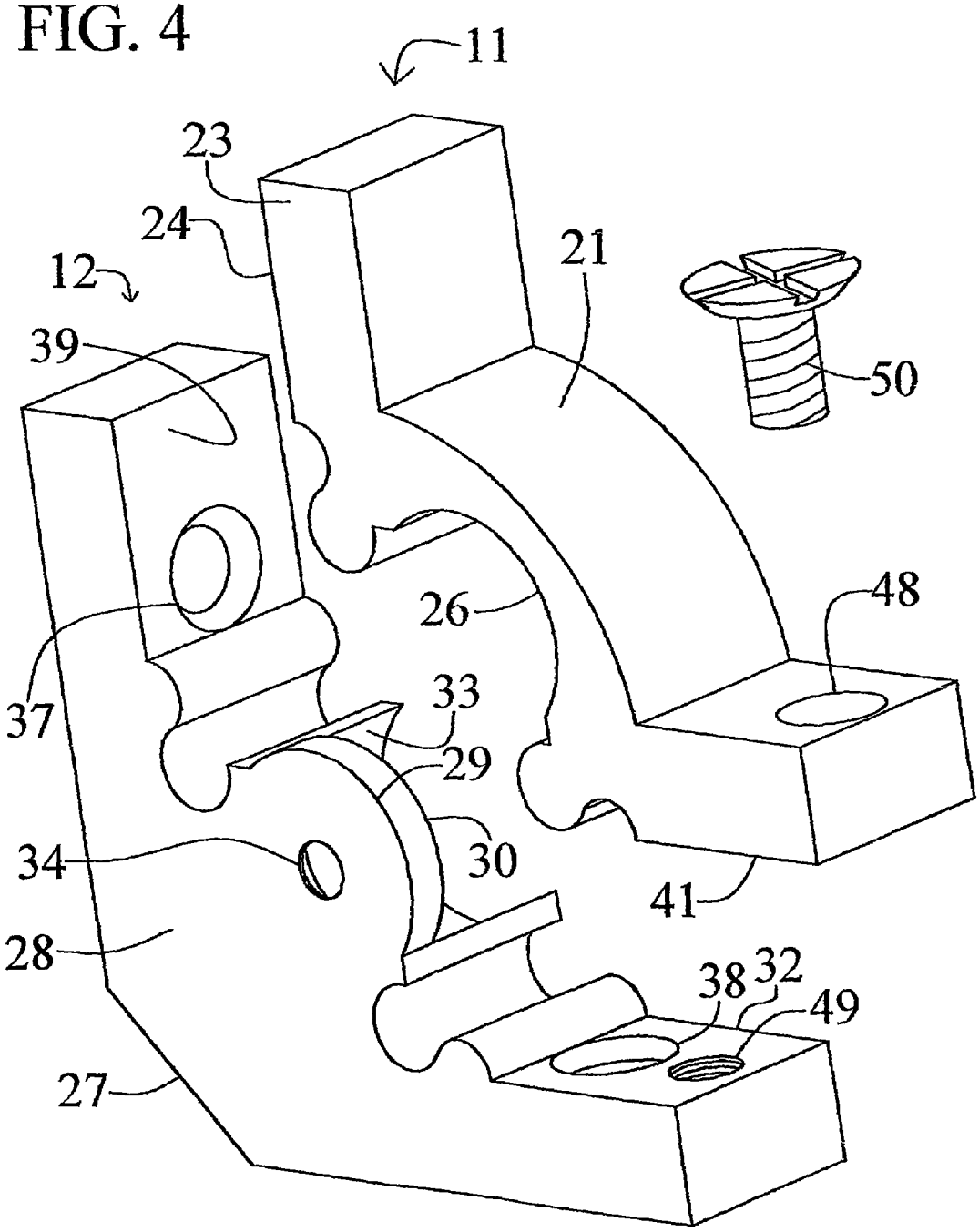
FIG. 4 is an exploded view of the top and bottom portions of a left sided stair rod bracket of the present invention.
Figure 5:
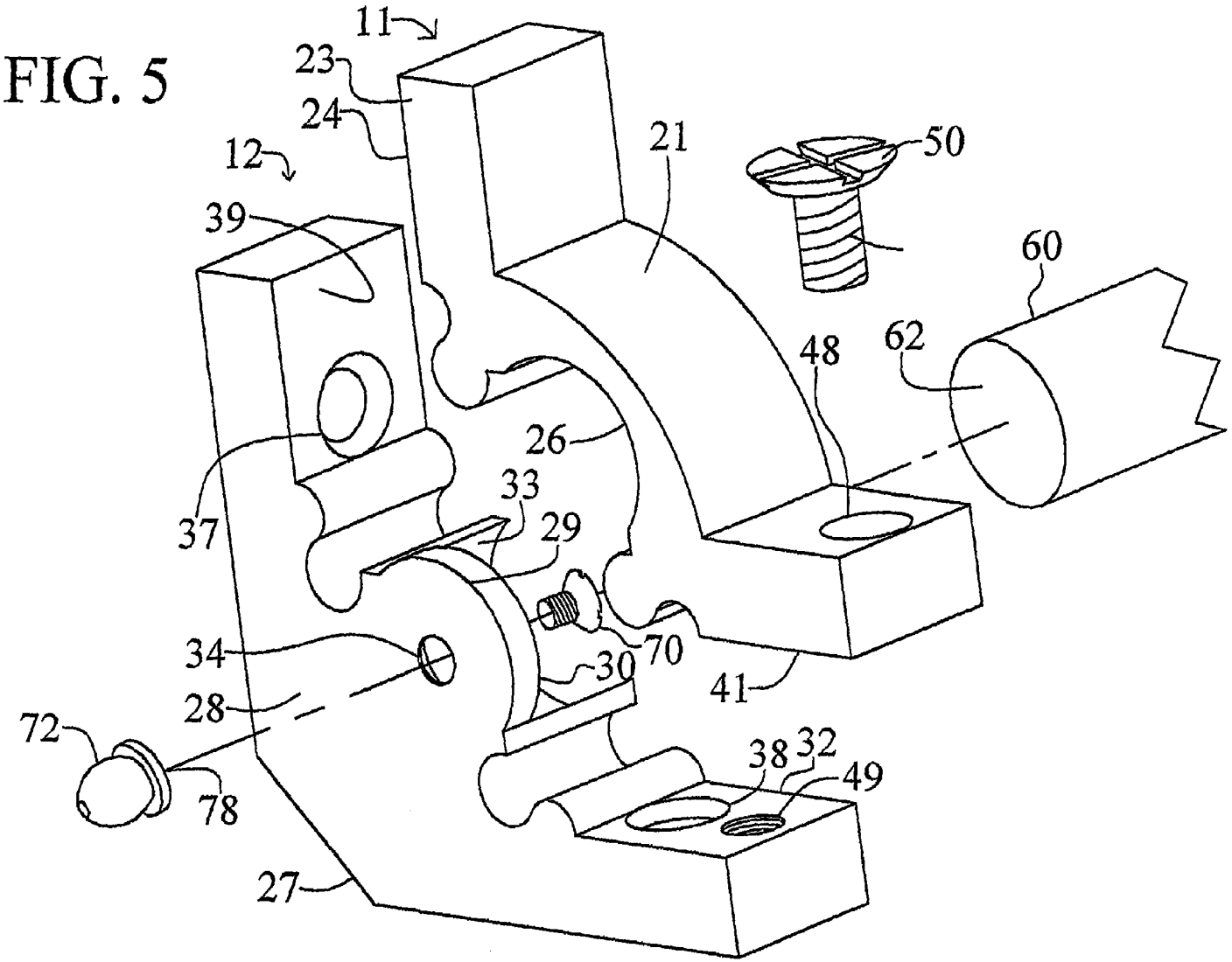
FIG. 5 is an exploded view of the top and bottom portions of a left sided stair rod bracket, a stair rod and a finial of the present invention.
Figure 6:
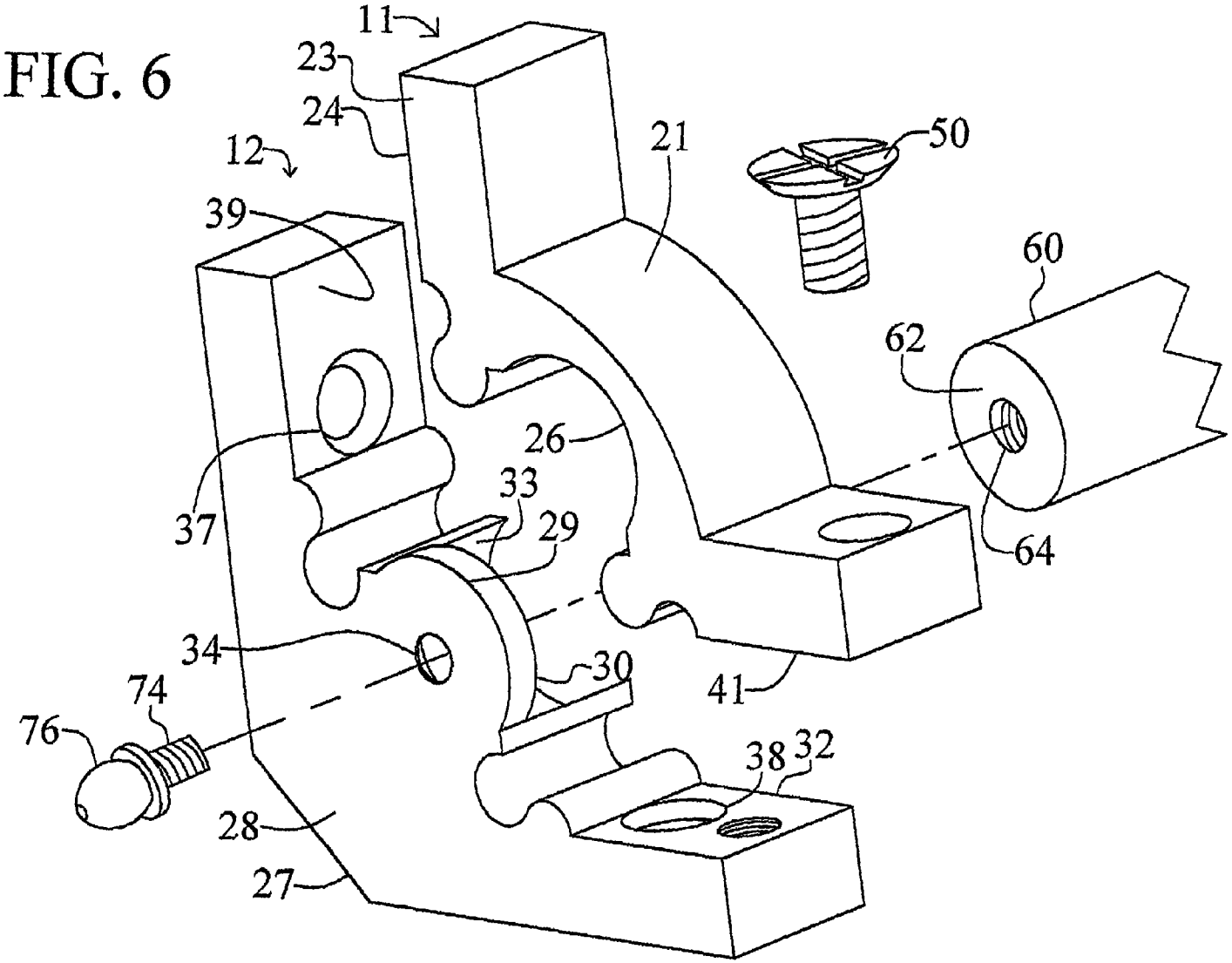
FIG. 6 is an exploded view of the top and bottom portions of a left sided stair rod bracket, a stair rod and a finial of the present invention.

As best shown in FIGS. 4-6, for each bracket 10, the outside end wall edge 29 of the bottom portion 12 and the corresponding end wall edge 41 of the top portion 11 are complementary in shape, such that these edges 29, 41 abut against each other when the top portion 11 of the bracket 10 is slid into the bottom portion 12 of the bracket 10. Thus, the edges 29 and 41 engage in a mating fashion. Likewise, the inside end wall edge 32 of the bottom portion 12 of the bracket 10 and the end wall edge 40 of the top portion 11 of the bracket 10 are complementary in shape, such that the edges 32, 40 abut against each other (except for the stair rod receiving portions 26, 33) when the top portion 11 of the bracket 10 is slid into the bottom portion 12 of the bracket 10. Thus, the edges 32 and 40 engage in a mating fashion, except for the stair rod receiving portions 26, 33. The stair rod receiving portions 26, 33, when the two portions 11 and 12 are combined to provide a bracket 10, create a rod receiving enclosure 42 which is sufficiently dimensioned to hold a portion of a stair rod 60 within the bracket 10. The transverse (lateral) travel of the rod 60 between the pair of brackets 10 (a left side stair bracket and a right side stair bracket) is limited by the inside surface 30 of the outside end wall 28 of the bottom portion 12 of the bracket 10. In each bracket 10, an end of a rod 62 abuts against the inside surface 30, of the outside end wall 28 of the bottom portion 12 of the end bracket 10. The rod can contain an aperture 64 which is aligned with the aperture 34 of the outside end wall 28 and is dimensioned to accept the male fastening portion 74 of a finial 72. The insertion of the male fastening portion 74 of the finial 72 through the finial fastener aperture 34, holds the rod to the stair rod bracket 10.

The abutting relationships of the pairs of edges 29, 41 and 32, 40 create a uni-body bracket construction that is unique to any prior art stair rod bracket and to any prior art stair rod set. The uni-body construction achieves a more sturdy construction of any previous stair rod set. The sturdiness creates a more secure installation of the stair carpet retaining rod 10, and hence, a safer installation of the stair rod set.

The structure of the pairs or abutting edges 29, 41 and 32, 40 and the structure of the mating engageable projections 13, 14, 17 and 18 and complementary channels 19, 20, 15 and 16 produce a bracket 10 which is very easy to assemble and disassemble. This is important because the structure of the bracket 10 permits the easy assembly/disassembly of the stair rod set, the easy removal of the top portion 11 of the bracket 10 for cleaning and polishing and the easy replacement of the top portion 11 of the bracket 10. No longer must the user/customer, carry solvents and polishing tools to the staircase to clean the top portions 11 of the bracket 10. The top portions 11 of the brackets 10 are easily removed from the bottom portion 12 of the brackets 10 by removing the bracket fastener screw 50 and sliding the top portion 11 in a transverse lateral direction, and the finials are loosened and removed. The bracket top portion 11 may then be collected and carried to a more convenient location than the staircase, to clean and polish them.

Another embodiment of the invention, best shown in FIGS. 5-6, is a stair rod set, specifically, a stair rod set having a stair carpet retaining rod 60, a pair of finials (72 or 76), and a pair of slidably interconnecting stair rod brackets 10, according to the present invention. The rod 60, the finials (72 or 76) and the brackets 10 are preferably made of metals, such as, but not limited to, brass, bronze, copper, aluminum, iron or steel or alloys thereof, and is most suitably made of brass. The brackets 10 can also be crafted out of wood or plastic. The brackets 10 are carved from a single mass of metal, most suitably brass. This provides an ease of manufacture over two-piece stair brackets containing two separately molded portions. Brackets of such manufacture often have difficulty fitting together due to variations in the separate molds. When the portions are carved out of a single piece of metal, the portions fit together near seamlessly.

Stair carpeting retaining rods 60 are known and are elongate in shape with opposed ends. These rods 60 have either a hollow core (often referred to as a hollow core-type rod) or a solid core (often referred to as a solid core-type rod). Stair carpeting retaining rods 60 are also known to come in various cross sectional shapes, such as circular, triangular, square, etc. Rods 60 are of a length sufficient to extend beyond a width of a carpet runner which is to be releasable affixed to a step of a staircase.

One embodiment of the stair carpet retaining rod 60 contains an aperture 64 at each opposing end 62. The apertures are suitably dimensioned to accept a fastening means extending from the finial 74. These rods 60 are also either of a solid core type having a solid metal cross section (i.e., a solid core) or of a hollow core type having a hollow core surrounded by a rod wall end.

The finals used in the present invention can either be a "male" finial 76 having a fastener projection 74, or a "female" finial 72 having a fastener receiving aperture 78. With a male finial 76, the male fastening portion 74 of the finial is of a length sufficient to be inserted into the bracket 10, securing it to the bracket. In one embodiment, the male finial 74 can be inserted through the aperture 34 of the bracket 10 so as to engage with an aperture 64 in the end of the rod 60, thereby fastening the bracket 10 to the rod 60. With a female finial 72, a finial fastener 70 of a length sufficient to be inserted through the aperture 34 aperture secures the female finial 72 to the bracket 10.

The pair of slidably interconnecting stair rod brackets 10 are disposed with one bracket 10 of the pair fastened at each end of the rod 60, when the stair rod set is assembled. The pair of brackets comprise a right side stair bracket and a left side stair bracket. While the top potion of the bracket is the same in both the right and left sided stair rod brackets, the two bottom portions are constructed as mirror images of each other. By the term "mirror image" is meant herein throughout that the parts of the two brackets are arranged with the reversal of right and left as would appear if seen in a mirror.

The present invention also comprehends a stair rod bracket kit and a stair rod kit. Because of the ease of use and simplicity of assembly and disassembly of the top portion 11 of the bracket, the bottom portion 12 of the bracket 10 may be used with interchangeable top portions 11. The top portions 11 are constructed identically to each other but, differ from each other in bearing decorative indicia, or alternatively no indicia, on the front face. Where no indicia is applied to the front face 21, a clean unadorned appearance free from any mechanical apertures or marks is achieved. Where indicia is applied, the indicia may be engraved or etched, or otherwise affixed to the front face. For example, the top portion 11 is suitably custom engraved to the user/customer's specification and can be changed with other top portions 11 to meet a user/customer's changing interior design schemes. This feature of the present invention permits the user/consumer to change the decorative look of the staircase by replacing only the top portion 11 of the bracket. This feature of top portion 11 interchangeability saves the user/customer money because only the top portion 11 of the bracket 10 bearing the indicia desired, needs to be purchased. This feature also protects the staircase since the bottom portion 12 does not need to be replaced, thereby preventing extra holes in the staircase where the bottom portion 12 had been affixed.

A stair rod bracket kit contains a plurality of top 11 and bottom portions 12. Fasteners may be included in the kit. The kit may be sold to outfit just the right side stair bracket, or just the left side stair bracket, or the kit may be sold to outfit both the right side stair bracket and the left side stair bracket.

A stair rod kit may contain a plurality of top portions 11, at least one left side stair bracket bottom portion 12, a stair carpet retaining rod 60, at lease one right side stair bracket bottom portion 12, and a pair of finials (72 or 76). Fasteners may be also be included in the kit.

The bracket and the stair rod set are assembled according to the steps of the following method. The carpet runner is arranged on the steps of the staircase. A pair of brackets 10 is needed for each side of each step of the staircase. One bracket 10 of the pair of brackets to be used on a step is affixed to the step first. For example, the left side stair bracket is fixed to the step; alternatively, the right side stair bracket could be affixed to the step first. The bottom portion 12 of the left side stair bracket is positioned on the step to one side of the carpet runner and secured to the step by affixing fasteners through the aperture 38 in the bottom portion 12 of the bracket 10. The top portion 11 of the left side stair bracket is held to the left or right of the bottom portion 12 and the projections 13, 14, 17 and 18 are aligned with complementary shaped channels—19, 20, 15 and 16. Once aligned, the top portion 11 is slid transversely (e.g., longitudinally or sideways) to the right or left, this movement positions and engages the top portion 11 in a mating fashion on top of the bottom portion 12 so that the pairs of edges abut and engage in a mating fashion. The top 11 and bottom portion 12 of the bracket 10 are fastened together by the bracket fastener screw 50 which engages with the first fastener aperture 48 and the second fastener 49, of the top 11 and bottom portion 12 respectively. The finial is then attached to the bracket. If a male finial 76 is used, the male fastening member 74 of the finial is threaded though the aperture 34. If a female finial 72 is used, a finial fastener 70 is threaded through the aperture 34 connecting the female finial 72 to the bracket 10. One end of rod 60 is placed in the rod receiving enclosure 42 and the rod is moved transversely so that the end of the rod 60 abuts the inside surface 30 of the outer end wall 28. If a male finial 76 is used, the male fastening portion of the finial 74 can be further threaded into an aperture 64 at the end of the rod 60 and fastened therein. Thus, the male fastening member 76 of the finial fastens the stair bracket 10 to the rod 60. The rod 60 in this position extends across the carpet runner.

The bottom portion 12 of the right side stair bracket is then positioned on the same step at a suitable distance from the left side stair bracket and to the right of the carpet runner. The bottom portion 12 of the right side stair bracket is secured to the step by affixing fasteners through the aperture 38 in the bottom portion 12 of the bracket 10. The other end (the non-fastened end) of the rod 60 is positioned into the rod receiving portion 33 of the inside end wall 31 of the bottom portion 12. The top portion 11 of the right side stair bracket is held to the right or left of the bottom portion 12 and the projections 13, 14, 17 and 18 are aligned with the respective complementary shaped channels 19, 20, 15 and 16. Once aligned, the top portion is slid transversely (longitudinally or sideways) to the right or left, this movement positions and engages the top portion 11 on top of the bottom portion 12 so that the pairs of edges abut. The top 11 and bottom 12 portion of the bracket 10 are fastened together by the bracket fastener screw 50 which engages with the first fastener aperture 48 and the second fastener, aperture 49 of the top 11 and bottom 12 portion respectively. When the top portion 11 and the bottom 12 portion are so aligned, the rod receiving portions (26 and 33) form the rod receiving enclosure 42 which is suitably dimensioned to receive the rod 60. The second finial portion (72 or 76) is then secured to the bracket 10. This action fastens the stair bracket 10 to the rod 60 and completes the assembly of the stair rod set of the present invention. The method of assembly is repeated for each step of the staircase.

To disassemble the stair rod set and the brackets for cleaning or polishing, or to change the top portions 11 of the brackets 10, the process is conducted in reverse order. The bracket fastener screw 50 is unfastened and removed. The brackets 10 are slid to disengage them. The bottom portions 12 of the left side stair bracket and of the right side stair bracket are left fastened to the step. The finials (72 or 76) are then unfastened and removed. The assembly steps are repeated for reassembling the bracket 10 and the stair rod set, except for the step of fastening the bottom portion 12 of the bracket 10 to the step, which is not needed.

When the stair rod bracket kit or the stair rod kit are used, the steps in the method of assembly is identical to that discussed above, except that prior to the method steps of positioning the top portion 11 on the bottom portion 12 of the respective bracket, one of a plurality of top portions 11 is selected by the user/consumer to be used. Likewise the method of disassembly is as previously stated herein throughout.

While the present invention has now been described and exemplified with some specificity, those skilled in the art will appreciate the various modifications, including variations, additions, and omissions, that may be made in what has been described. Accordingly, it is intended that these modifications also be encompassed by the present invention and that the scope of the present invention be limited solely by the broadest interpretation that lawfully can be accorded the appended claims.

The invention claimed is:

1. A stair rod bracket comprising:

a top portion having a front face, a back face, two end walls that each extend downwardly from the front face of the top portion to the back face of the top portion, a first projection and a first channel;

a bottom portion having a front face, a back face, a first projection, a first channel, an outside end wall extending up from the back face of the bottom portion, the outside end wall having a finial fastener aperture, an inside end wall extending directly up from the back face of the bottom portion, and a stair rod receiving portion;

wherein the first projection of the top portion is designed to be received in the first channel of the bottom portion and the first projection of the bottom portion is designed to be received in the first channel of the top portion; and wherein the receipt of the first projection of the top portion in the first channel of the bottom portion and the first projection of the bottom portion in the first channel of the top portion allows for transverse engagement of the top portion with the bottom portion from either a right or left side of the bottom portion.

2. The bracket of claim 1, wherein the top portion further comprises a second projection and a second channel and the bottom portion further comprises a second projection and a second channel;

wherein the second projection of the top portion is designed to be received in the second channel of the bottom portion and the second projection of the bottom portion is designed to be received in the second channel of the top portion; and wherein the receipt of the second projection of the top portion in the second channel of the bottom portion and the second projection of the bottom portion in the second channel of the top portion allows for transverse engagement of the top portion with the bottom portion.

3. The bracket of claim 1, wherein the top face of the top portion further comprises a first fastener aperture and the top face of the bottom portion further comprises a mounting aperture and a second fastener aperture; and a fastener passes through the first and second fastener aperture and secures the top portion to the bottom portion.

4. The bracket of claim 1 wherein both first projections are rounded.

5. The bracket of claim 2 wherein the first projection of the top portion is adjacent to the first channel of the top portion, and the second projection of the top portion is adjacent to the second channel of the top portion; and wherein the first projection of the bottom portion is adjacent to the first channel of the bottom portion and the second projection of the bottom portion is adjacent to the second channel of the bottom portion.

6. The bracket of claim 5 wherein:

the top face of the top portion further comprises a first fastener aperture;

the top face of the bottom portion further comprises a mounting aperture, a second fastener aperture;

a fastener, which passes through the first and second fastener apertures and secures the top portion to the bottom portion; and wherein the projections of the top portion and the bottom portion are rounded.

7. A stair rod bracket comprising:

a top portion having a front face, a back face, a first end wall and a second end wall which each extend downwardly from the front face to the back face, a first end wall edge and a second end wall edge, a first fastener aperture passing through the front and back face of the top portion, a plurality of rounded projections and a plurality of channels;

a bottom portion having a front face having a second fastener aperture and a first mounting aperture, a back face, an outside end wall extending directly up from the back face of the bottom portion, the outside end wall having a finial fastener aperture and an inside end wall, a plurality of rounded projections and a plurality of channels;

wherein the outside end wall of the bottom portion has an outside end wall edge and an inside surface;

wherein the inside end wall of the bottom portion has an inside end wall edge and a stair rod receiving portion; and wherein the outside end wall edge of the bottom portion is complementary in shape to the first end wall edge of the top portion such that when the top portion is slid over the bottom portion, from either a right or left side of the bottom portion, the first end wall edge of the top portion and the outside end wall edge of the bottom portion engage in a mating fashion.

8. A stair rod bracket comprising:

a top portion having a front face, a back face, a first end wall and a second end wall which each extend downwardly from the front face to the back face, a first end wall edge and a second end wall edge, a first fastener aperture passing through the front and back face of the top portion, a first rounded projection adjacent to a first channel, a second rounded projection adjacent to a second channel;

a bottom portion having a front face having a second fastener aperture and a first mounting aperture, a back face, an outside end wall extending directly up from the back face of the bottom portion, the outside end wall having a finial fastener aperture, an inside end wall, a first rounded projection adjacent to a first channel, a second rounded projection adjacent to a second channel;

wherein the outside end wall of the bottom portion has an outside end wall edge and an inside surface;

wherein the inside end wall of the bottom portion has an inside end wall edge and a stair rod receiving portion; and wherein the front face and the outside end wall edge of the bottom portion is complementary in shape to the back face of the top portion such that when the top portion is slid over the bottom portion, from either a right or left side of the bottom portion, the front face and the outside end wall edge of the bottom portion engage in a mating fashion with the back face of the top portion and define a rod receiving enclosure.

9. A stair rod set comprising:

a stair rod;

a pair of stair rod brackets, each bracket having a top portion having a front face, a back face, two end walls that each extend downwardly from the front face of the top portion to the back face of the top portion, a first projection and a first channel;

a bottom portion having a front face, a back face, a first projection, a first channel, an outside end wall extending directly up from the back face of the bottom portion, the outside end wall having a finial fastener aperture, an inside end wall extending up from the back face of the bottom portion, and a stair rod receiving portion;

wherein the first projection of the top portion is designed to be received in the first channel of the bottom portion and the first projection of the bottom portion is designed to be received in the first channel of the top portion; and wherein the receipt of the first projection of the top portion in the first channel of the bottom portion and the first projection of the bottom portion in the first channel of the top portion allows for transverse engagement of the top portion with the bottom portion from either a right or left side of the bottom portion.

10. The stair rod set of claim 9 wherein the set further comprises a pair of finials.

11. The stair rod set of claim 10 wherein each finial has a threaded aperture.

12. The stair rod set of claim 10 wherein each finial has a male fastening portion adapted to pass through the aperture in the outside end wall.

13. The stair rod set of claim 12 wherein the stair rod contains an aperture on an end of the rod dimensioned to accept the male fastening portion of the finial.

14. A stair rod set comprising:

a plurality of top portions of a bracket, each top portion having a front face, a back face, two end walls that each extend downwardly from the front face of the top portion to the back face of the top portion, a first projection and a first channel;

a plurality of bottom portions of a bracket, each bottom portion having a front face, a back face, a first projection, a first channel, an outside end wall extending directly up from the back face of the bottom portion, the outside end wall having a finial fastener aperture, an inside end wall extending up from the back face of the bottom portion, and a stair rod receiving portion;

wherein the first projection of the top portion is designed to be received in the first channel of the bottom portion and the first projection of the bottom portion is designed to be received in the first channel of the top portion, such that the top portion is capable of transversely engaging the bottom portion from either a right or left side of the bottom portion.

15. The stair rod set of claim 14 further comprising:

at least one stair rod;

at least two finials.

16. The stair rod set of claim 14 wherein each top portion further comprises a second projection and a second channel and wherein each bottom portion further comprises a second projection and a second channel;

wherein the second projection of the top portion is designed to be received in the second channel of the bottom portion and the second projection of the bottom portion is designed to be received in the second channel of the top portion.

17. The stair rod set of claim 16 wherein the first projection of each top portion is adjacent to the first channel of each top portion, and the second projection of each top portion is adjacent to the second channel of each top portion; and wherein the first projection of each bottom bracket is adjacent to the first channel of each bottom portion and the second projection of each bottom portion is adjacent to the second channel of each bottom portion.

18. The stair rod set of claim 14 wherein the plurality of top portions differ from one another in the absence or presence of indicia applied to the face of the top portions or in the presence of differing indicia to the face of the top portions.

* * * * *